US011889913B2

(12) United States Patent
Yoo

(10) Patent No.: US 11,889,913 B2
(45) Date of Patent: Feb. 6, 2024

(54) BACKPACK

(71) Applicant: Ted Hwan Yoo, Seoul (KR)

(72) Inventor: Ted Hwan Yoo, Seoul (KR)

( * ) Notice: Subject to any disclaimer, the term of this patent is extended or adjusted under 35 U.S.C. 154(b) by 0 days.

(21) Appl. No.: 17/721,576

(22) Filed: Apr. 15, 2022

(65) Prior Publication Data

US 2022/0232954 A1 Jul. 28, 2022

Related U.S. Application Data

(62) Division of application No. 17/116,375, filed on Dec. 9, 2020, now Pat. No. 11,330,892.

(30) Foreign Application Priority Data

Jan. 21, 2020 (KR) ..... 10-2020-0008066

(51) Int. Cl.

| | |
|---|---|
| ***A45F 3/04*** | (2006.01) |
| ***A45C 7/00*** | (2006.01) |
| *A45F 3/00* | (2006.01) |

(52) U.S. Cl.

CPC ..... *A45F 3/04* (2013.01); *A45C 7/0063* (2013.01); *A45F 2003/001* (2013.01)

(58) Field of Classification Search

CPC .... A45F 3/02; A45F 3/04; A45F 3/042; A45F 3/047; A45F 3/06; A45F 3/08; A45F 3/12;

(Continued)

(56) References Cited

U.S. PATENT DOCUMENTS 4,972,981 A 11/1990 Gex
5,369,843 A * 12/1994 Yu ..... E05C 17/34 16/346

(Continued)

FOREIGN PATENT DOCUMENTS

KR 102308665 B1 * 10/2021

*Primary Examiner* — Scott T McNurlen
(74) *Attorney, Agent, or Firm* — Birch, Stewart, Kolasch & Birch, LLP

(57) ABSTRACT

A backpack including a first backpack member provided on both sides thereof with shoulder straps, a second backpack member configured onto a rear surface of the first backpack member, and an auxiliary loading portion configured to fix the bottom surfaces of the first backpack member and the second backpack member to each other to enable the first backpack member and the second backpack member to be unfolded in opposite directions, and configured to be exposed outward from the first backpack member and the second backpack member, the backpack including a buckle for coupling at least both side portions of the first backpack member and the second backpack member to each other, wherein the auxiliary loading portion is formed by coupling a pair of panels to each other by a first hinge so as to be folded inward only, in which one of the pair of panels coupled by the first hinge is rotatably fixed to the first backpack member via a second hinge therebetween, and an opposite one of the pair of panels coupled by the first hinge is rotatably fixed to the second backpack member via a third hinge therebetween, so that a gap between the first backpack member and the second backpack member is prevented from being widened, and the first hinge and the pair of panels folded only inward prevent an article loaded on the auxiliary loading portion from sagging, thereby preventing a center of gravity of the backpack from being changed.

6 Claims, 8 Drawing Sheets

(58) Field of Classification Search
CPC ..... A45F 2003/001; A45F 2003/003; A45F 2003/025; A45F 2003/045; A45F 2003/122; A45F 2003/125; A45F 2003/127; A45C 7/0063
USPC ..... 224/581–582, 609, 627–659; 248/284.1
See application file for complete search history.

(56) References Cited

U.S. PATENT DOCUMENTS

| | | | | |
|---|---|---|---|---|
| 5,810,223 | A * | 9/1998 | Helm | A45C 3/02 224/259 |
| 6,315,177 | B1 * | 11/2001 | Weatherall | A45F 4/02 224/259 |
| 6,371,288 | B1 * | 4/2002 | Licata | A45C 13/02 206/214 |
| 7,757,912 | B1 * | 7/2010 | Fabro | A45F 4/02 297/129 |
| 8,348,114 | B2 | 1/2013 | Gleason, Jr. | |
| 8,397,965 | B2 | 3/2013 | Eberle | |
| 9,049,916 | B2 | 6/2015 | Berei | |
| 9,138,631 | B2 | 9/2015 | Scholl | |
| 2016/0133239 | A1 | 5/2016 | Hook | |

* cited by examiner

BACKPACK

CROSS-REFERENCE TO RELATED APPLICATIONS

This Application is a Divisional of U.S. patent application Ser. No. 17/116,375 filed on Dec. 9, 2020, which claims the benefit under 35 U.S.C. § 119(a) to Patent Application No. 10-2020-0008066, filed in the Republic of Korea on Jan. 21, 2020, all of which are hereby expressly incorporated by reference into the present application.

BACKGROUND OF THE INVENTION

Field of the Invention

The present invention relates to a backpack, and more particularly, to a backpack structure capable of easily and stably fixing an item or the like, which cannot be put into a storage space inside the backpack, to the backpack.

Discussion of the Related Art

In general, a backpack is used to conveniently store and carry items, and the use and form are diversified according to the needs of consumers.

Referring to the structure described in Korean Patent Registration No. 10-1255673, an example of a typical backpack as shown FIGS. 1 and 2 includes a back plate portion 100 having shoulder straps 110 on both sides, a storage portion 200 that is connected to the back plate portion by sharing one side 120 of a left side or a right side, and includes a space for storing items therein in which the other side except for the one side is separated from the back plate portion, and a connection portion 300 connecting the back plate portion to the storage portion, and formed by using any one selected from a zipper, a fastener, a hook, a button, and a Velcro tape.

As described above, the back plate portion 100 and the storage portion 200 are configured to be separable, so that the connection portion 300 is separated when the items are taken out from the backpack worn on a back to allow only the store portion 200 to be freely rotated. Thus, the items can be freely taken out from the storage portion without removing the backpack from the back.

However, since the backpack configured as above has a limit in size, some items may not be placed in the storage space of the backpack and may be required to be carried while being hung outside the backpack. In addition, due to the items hung outside the backpack, a time delay and disorder may occur when the items placed in the storage space inside the backpack are taken out.

(Patent Document 1) Korean Registered Patent No. 10-1255673

SUMMARY OF THE INVENTION

The present invention has been proposed to solve the above problems, and the present invention provides a backpack structure that allows items to be simply loaded even when the items to be loaded have a large column shape or "T"-shape, which cannot be put into a storage space of a backpack.

The present invention further provides a backpack structure that can be safely worn on the shoulder by maintaining the fit and balance even when a large item is stored in a backpack.

The present invention still further provides a backpack structure in which the opening and closing of a storage space of a backpack is not affected even when a large item is stored in the backpack.

To solve the above objects, a backpack of the present invention includes: a first backpack member provided on both sides thereof with shoulder straps; a second backpack member configured onto a rear surface of the first backpack member; and an auxiliary loading portion fixed to bottom surfaces of the first backpack member and the second backpack member to have a predetermined width, and further includes a buckle for coupling both sides of the first backpack member and the second backpack member to each other, wherein at least a lower portion of the auxiliary loading portion is always exposed outward from the first backpack member and the second backpack member, a width of the auxiliary loading portion is compactly reduced and fixed by pulling both ends of twines inserted into twine guide paths formed at both edges of the auxiliary loading portion, or the first backpack member and the second backpack member are unfolded in opposite directions even while the auxiliary loading portion is fixed to have a predetermined width by pulling the both ends of the twines inserted into the twine guide paths, and the center of gravity of the backpack is prevented from being changed when the item is loaded on the auxiliary loading portion fixed to have the predetermined width by the twines.

In addition, the backpack of the present invention includes a first backpack member provided on both sides thereof with shoulder straps; a second backpack member configured onto a rear surface of the first backpack member; an auxiliary loading portion configured to fix the bottom surfaces of the first backpack member and the second backpack member to each other to enable the first backpack member and the second backpack member to be unfolded in opposite directions, and configured to be exposed outward from the first backpack member and the second backpack member; and a buckle for coupling at least both side portions of the first backpack member and the second backpack member to each other, wherein the auxiliary loading portion is formed by coupling a plurality of panels to each other by a first hinge, in which one of the panels coupled by the first hinge is rotatably fixed to the first backpack member via a second hinge, and an opposite one of the panels coupled by the first hinge is rotatably fixed to the second backpack member via a third hinge.

In addition the first backpack member may serve as a backrest, and the second backpack member may include a storage portion.

In addition the first backpack member and the second backpack member may include storage portions, respectively.

Advantageous Effects

The backpack of the present invention a first backpack member provided on both sides thereof with shoulder straps; a second backpack member configured onto a rear surface of the first backpack member; an auxiliary loading portion configured to fix the bottom surfaces of the first backpack member and the second backpack member to each other to enable the first backpack member and the second backpack member to be unfolded in opposite directions, and configured to be exposed outward from the first backpack member and the second backpack member, and a buckle for coupling both sides of the first backpack member and the second backpack member to each other, wherein the auxiliary loading portion may include a spacing adjusting device capable of adjusting a spacing according to the item loaded between the first backpack member and the second backpack member, so that a large item that does not fit into the storage portion of the backpack can be simply loaded in the backpack.

In addition, the storage portion of the backpack may be easily opened and closed even when the large item is loaded in the backpack, so that the large item can be prevented from interfering with removing/placing other items from/to the storage portion of the backpack.

In addition even when the large item is loaded in the backpack, the balance for the center of gravity of the backpack can be maintained.

DETAILED DESCRIPTION OF THE EMBODIMENTS

Hereinafter, the technical configuration and the function of a backpack of the present invention will be described in detail with reference to FIGS. 3 to 8.

Figure 1:
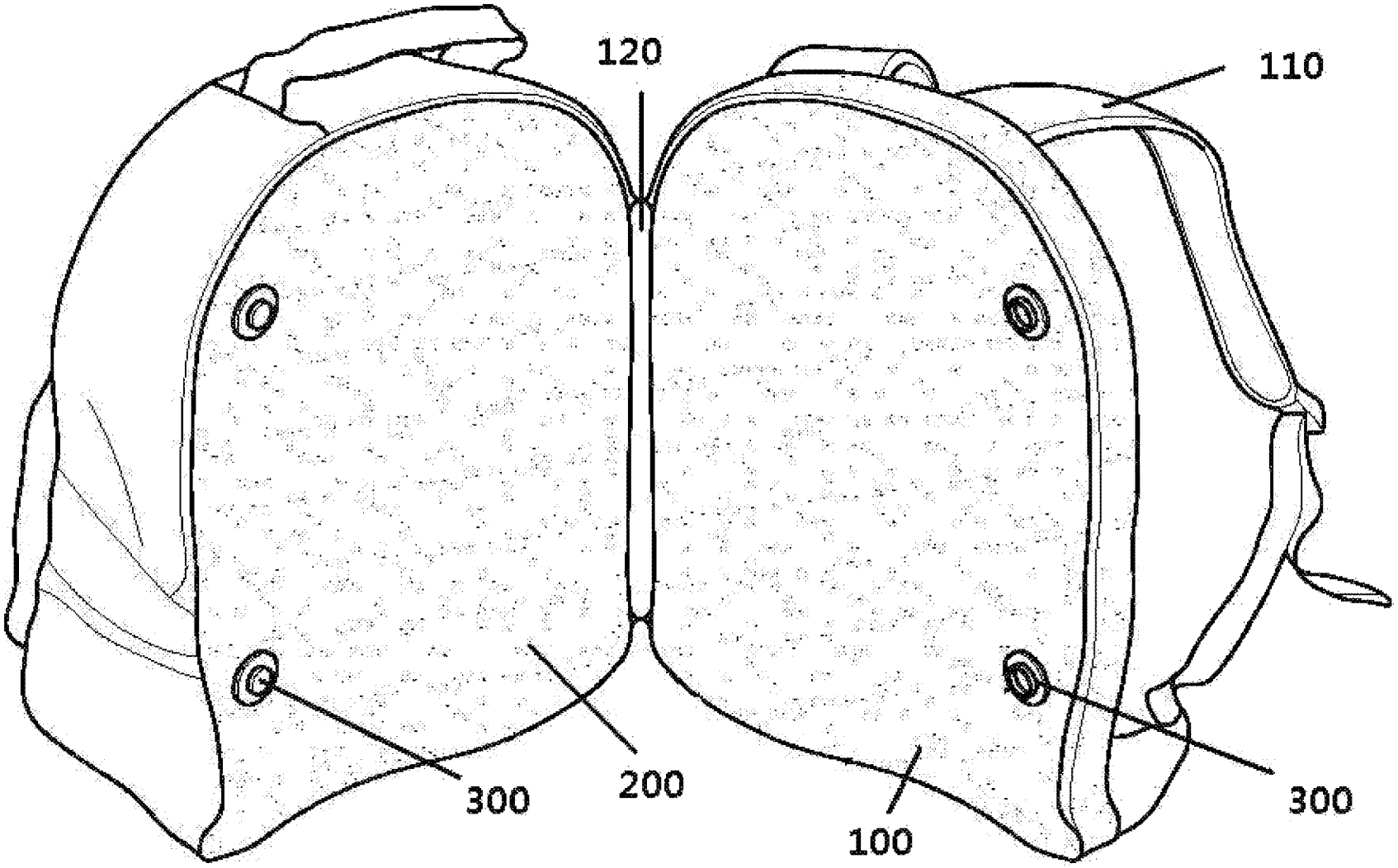
FIG. 1 is a three-dimensional view showing a state in which a back plate portion and a storage portion of a conventional backpack are separated from each other.
Figure 2:
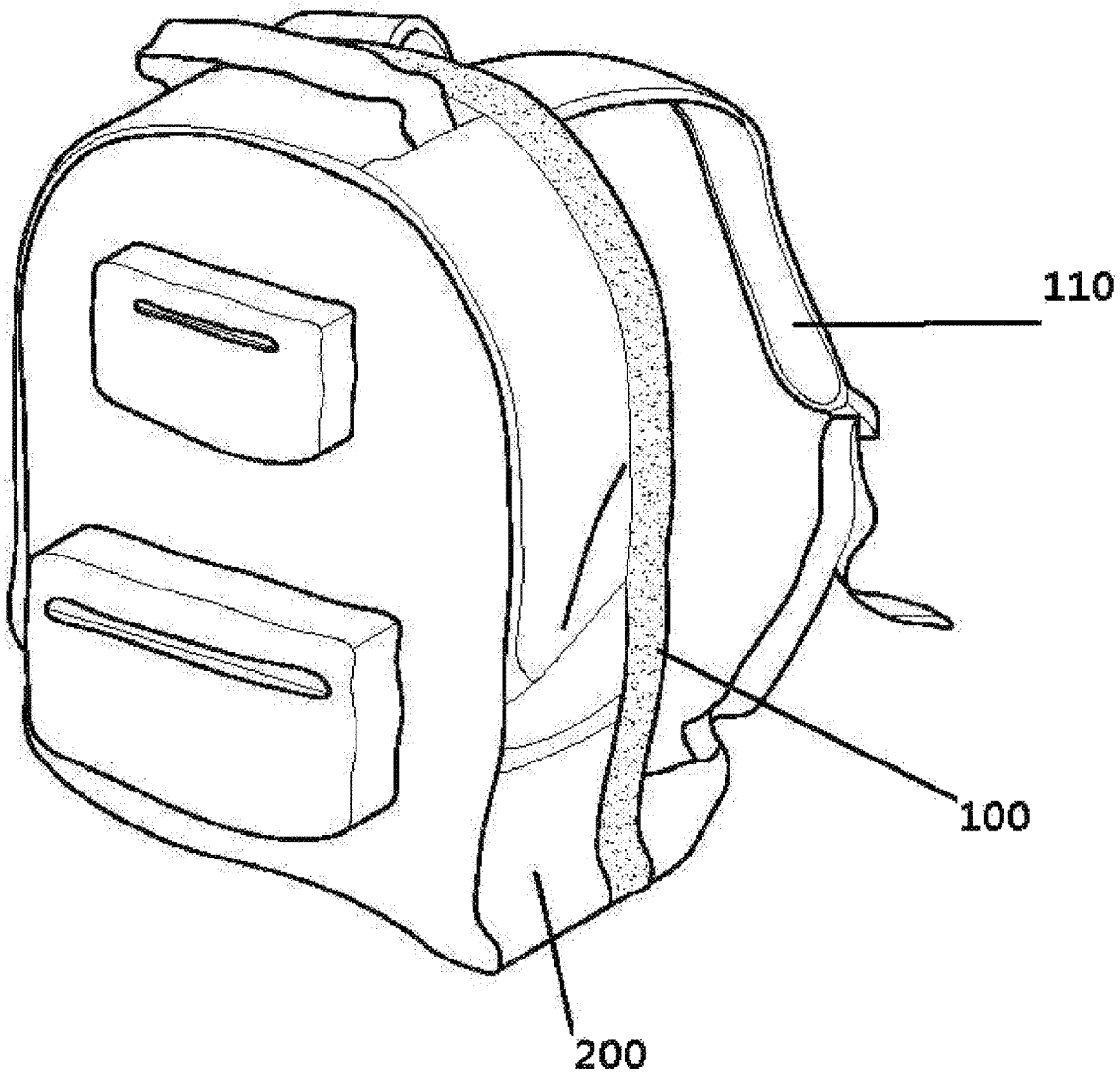
FIG. 2 is a three-dimensional view showing a state in which the back plate portion and the storage portion of the conventional backpack are coupled to each other.
Figure 3:
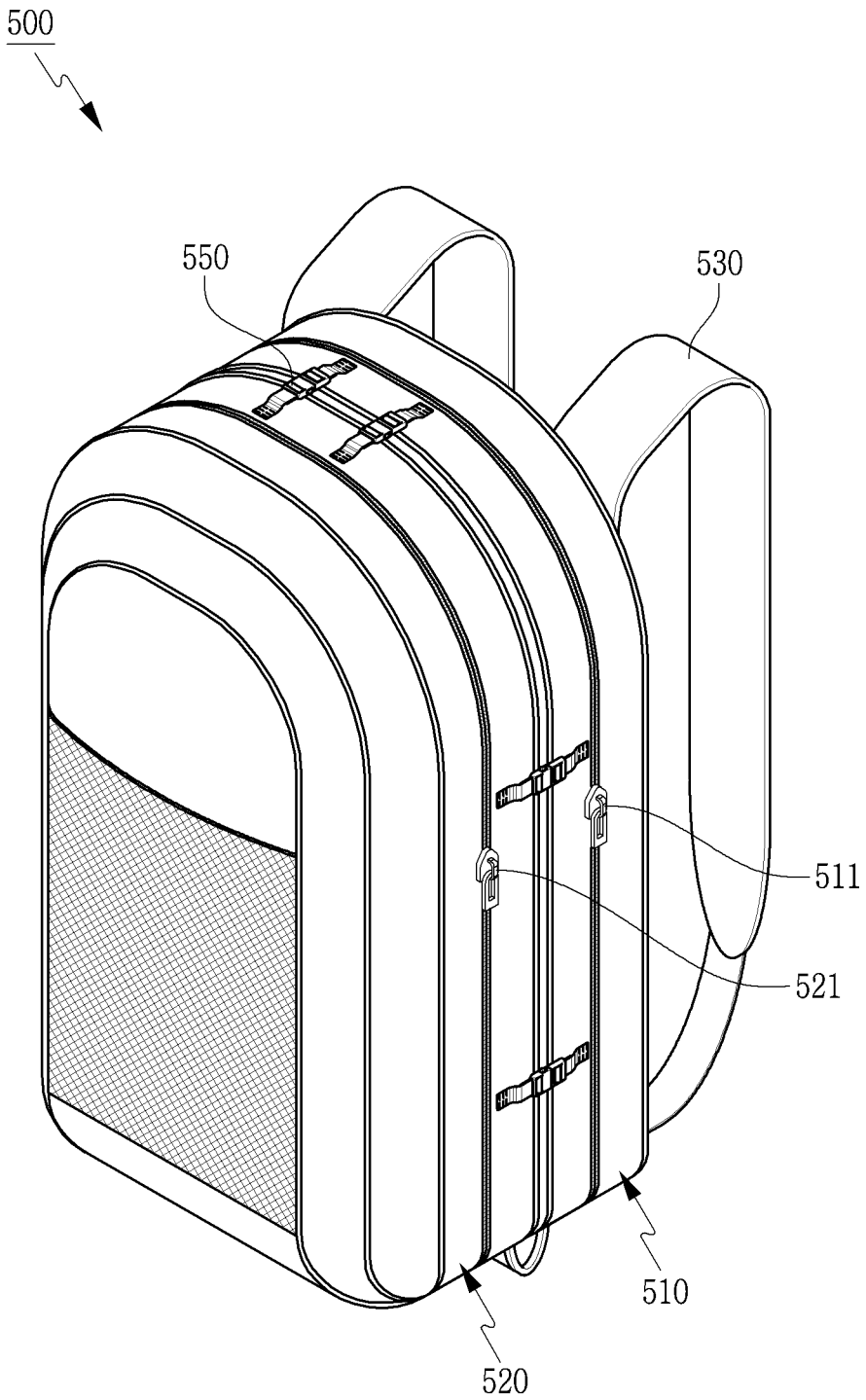
FIG. 3 is a three-dimensional view showing an example of a backpack in which a first backpack member and a second backpack member are combined to each other according to the present invention.
Figure 4:
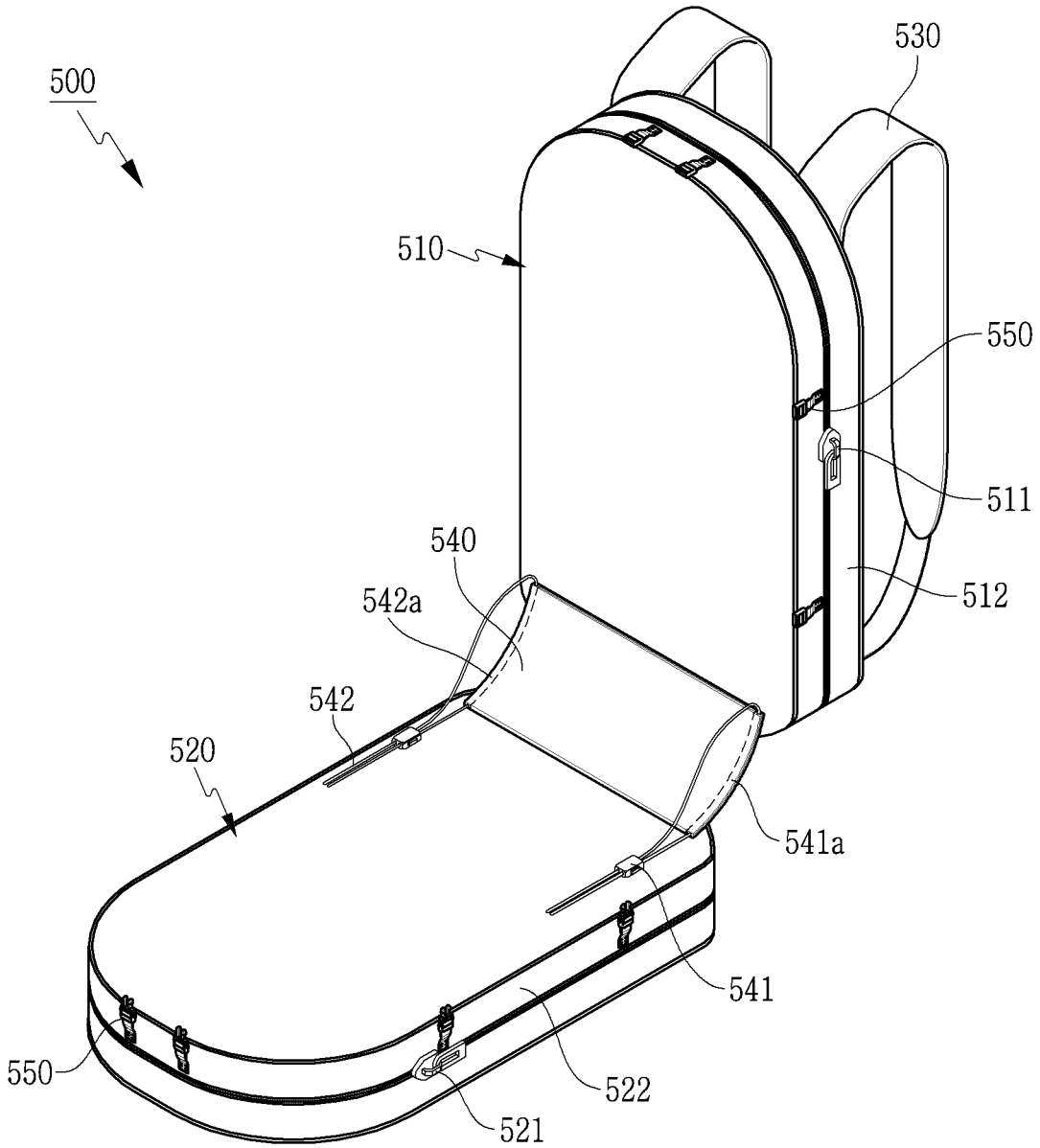
FIG. 4 is a three-dimensional view showing a state in which the first backpack member and the second backpack member of FIG. 3 are unfolded.

As shown FIGS. 3 and 4, a backpack 500 of the present invention includes a first backpack member 510, a second backpack member 520, a pair of shoulder straps 530 provided in the first backpack member, and an auxiliary loading portion 540 connecting and fixing bottom surfaces of the first backpack member and the second backpack member to each other.

The first backpack member 510 includes a storage portion 512 opened by a zipper 511 or the like. The second backpack member 520 configured onto a rear surface of the first backpack member 510 also includes a storage portion 522 opened by a zipper 521 or the like.

The first backpack member 510 and the second backpack member 520 are not necessarily limited as having the storage portions 512 and 522, respectively. The storage unit 512 may be omitted in the first backpack member 510.

In the case of omitting the configuration of the storage portion 512 in the first backpack member 510, the first backpack member 510 may be configured as a structure that can substantially serve as a backrest only.

In particular, the auxiliary loading portion 540 is configured to fix the bottom surfaces of the first backpack member 510 and the second backpack member 520 to each other, so that the first backpack member and the second backpack member are unfolded in opposite directions, and configured to be exposed outward from the first backpack member 510 and the second backpack member 520. As shown in FIG. 4 as an example, the auxiliary loading portion 540 may be formed to fix the bottom surfaces of the first backpack member 510 and the second backpack member 520 to each other by using a rectangular flexible member (such as leather, felt, and cloth), and twine guide paths 541*a* and 542*a* through which twines 541 and 541 are inserted may be formed at both edges of the auxiliary loading portion 540, respectively.

In addition a plurality of buckles 550 adjustable in length may be fixed on peripheries of the first backpack member 510 and the second backpack member 520, so that the first backpack member 510 and the second backpack member 520 may be coupled to each other.

Figure 5:
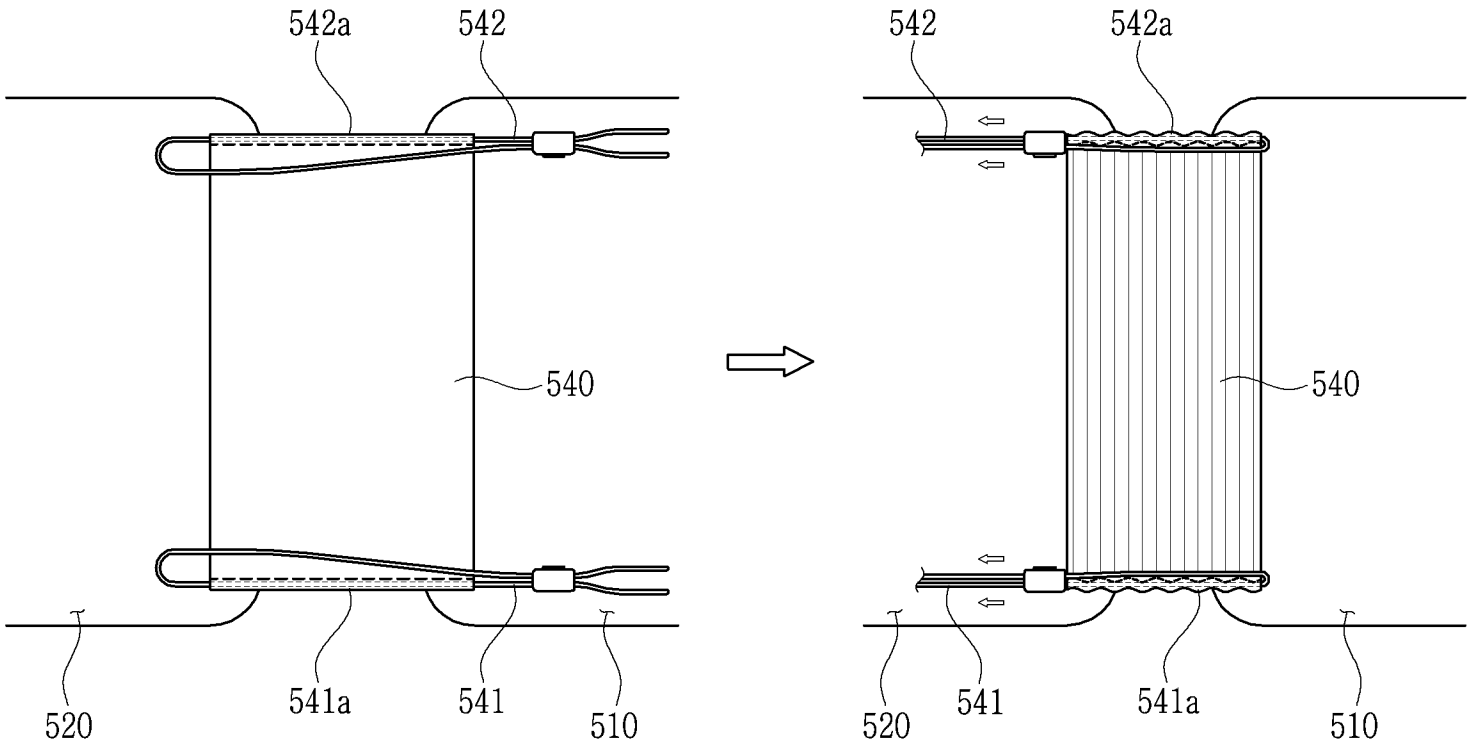
FIG. 5 is a view for explaining a distance adjustment of an auxiliary loading portion of the present invention.

As shown in FIG. 5, when the auxiliary loading portion 540 is used, the first backpack member 510 and the second backpack member 520 are unfolded to both sides, the twine 541*a* and 542*a* are loosened to secure a sufficient width of the auxiliary loading portion 540, a large item is loaded thereon, the first backpack member 510 and the second backpack member 520 are erected to initial positions, and the first backpack member 510 and the second backpack member 520 are firmly fixed by the buckles 550. On the other hand, when the auxiliary loading portion 540 is not used, the twines 541*a* and 542*a* are pulled to compactly shrink the auxiliary loading portion 540, so as to prevent a gap between the first backpack member 510 and the second backpack member 520 from opening, and prevent the auxiliary loading portion 540 from being excessively exposed outward from the first backpack member 510 and the second backpack member 520.

Figure 6:
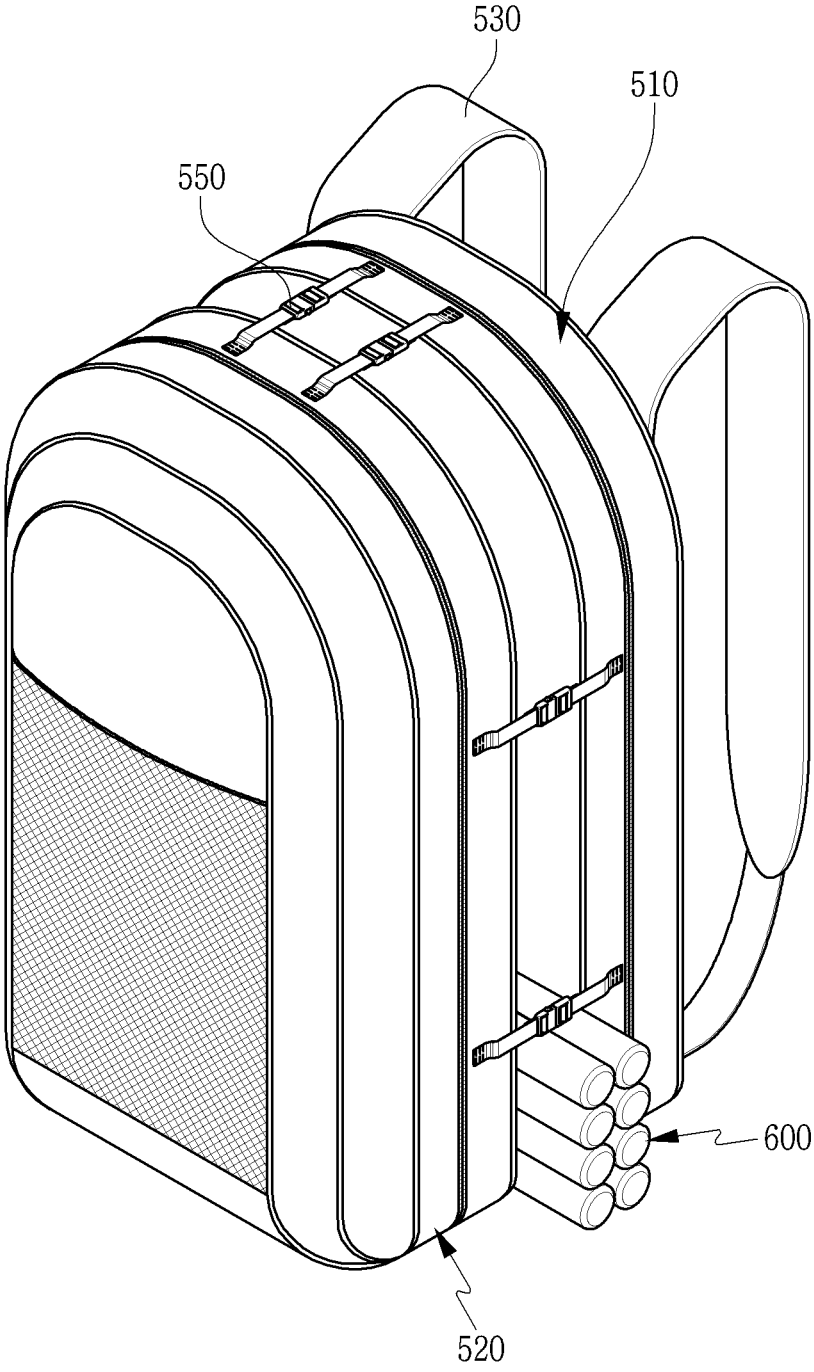
FIG. 6 is a view for explaining another example of the auxiliary loading portion of the present invention.
Figure 7:
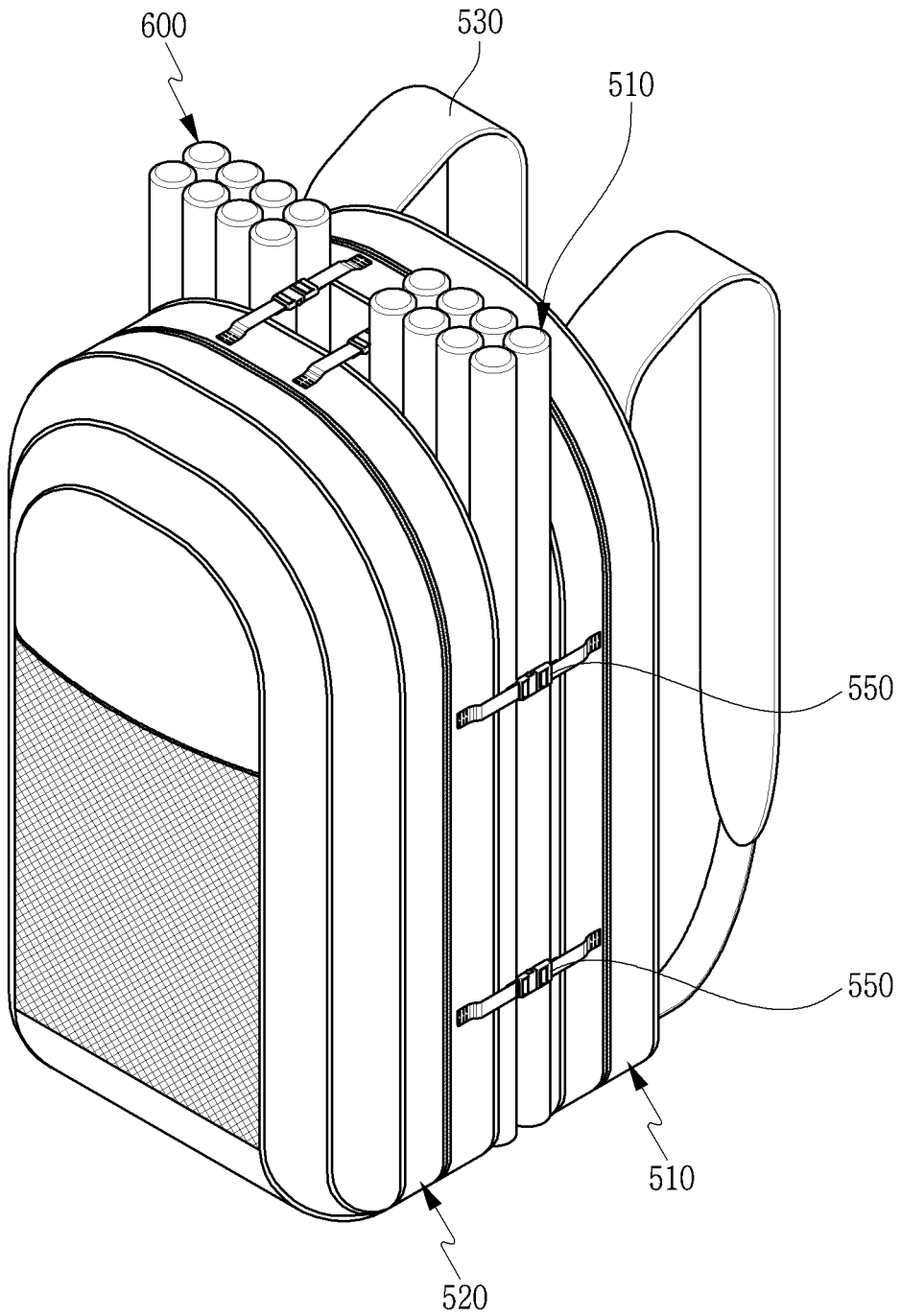
FIGS. 7 and 8 are three-dimensional views showing a state in which large-sized items are loaded in the backpack of the present invention.

According to the backpack 500 of the present invention configured in the above manner, as shown FIGS. 6 and 7, a large item 600 that does not fit into the storage portion of the backpack can be simply loaded and fixed to the auxiliary loading portion 540 positioned between the first backpack member 510 and the second backpack member 520.

The large-sized item 600 can be easily loaded regardless of a shape such as "I"-type or "T"-type, and the center of gravity of the backpack does not change even when the item is loaded.

Figure 8:
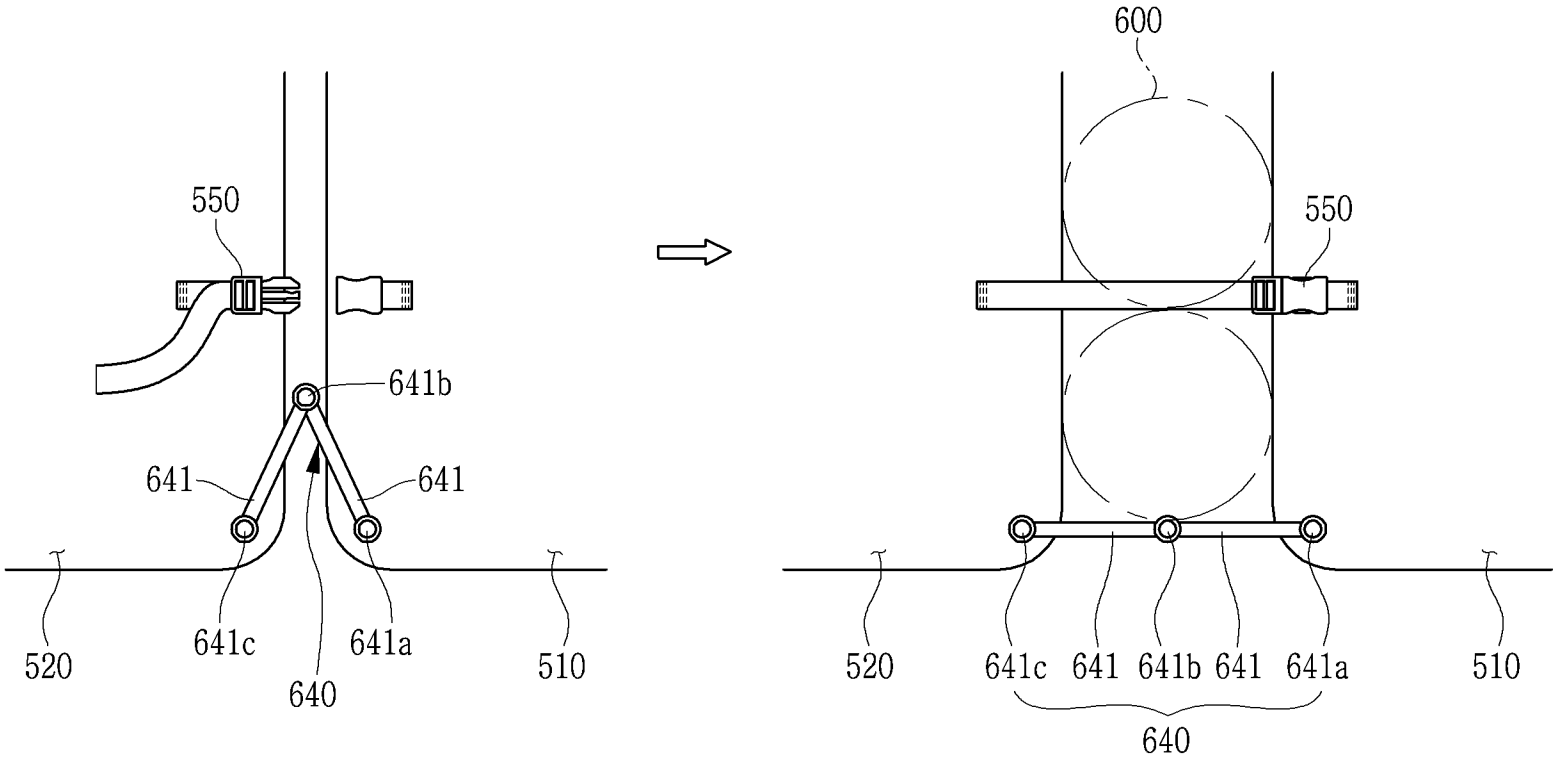

The auxiliary loading portion of the present invention is not limited to the structure of FIGS. 4 and 5, and may be configured to have a folding type as shown in FIG. 8.

When the auxiliary loading portion 640 is configured in the folding type, two panels 641 and 641 are coupled to each other by a hinge 641*b*, in which one of the panels is rotatably fixed to the first backpack member 510 via a hinge 641*a*, and the other one of the panels is rotatably fixed to the second backpack member 520 via a hinge 641*c*.

When the auxiliary loading portion 640 is not used, the panels 641 and 641 are folded to compactly reduce a distance thereof, so that the gap between the first backpack member 510 and the second backpack member 520 may be prevented from being widened. On the contrary, when the auxiliary loading portion 640 is in use, the panels 641 and 641 are unfolded to widen the gap, so that the item 600 having a large size may be loaded thereon.

Although FIG. 8 illustrates a structure in which only one pair of panels are configured to constitute the auxiliary loading portion 640, at least three panels may be hinged so as to adjust the width as necessary. In other words, necessary panels among a plurality of panels may be unfolded as needed, and the remaining panels may be stacked upright.

The backpack 500 of the present invention as described above is not limited to the description and configuration of the drawings illustrated above, and various modifications may be made within the scope of the claims and the purposes of the present invention.

The present invention relates to a backpack that may easily load an item having a large size.

What is claimed is:

1. A backpack comprising:

a first backpack member provided on both sides thereof with shoulder straps, a second backpack member configured onto a rear surface of the first backpack member, and an auxiliary loading portion attached to an exterior of the first backpack member and the second backpack member and configured to fix the bottom surfaces of the first backpack member and the second backpack member to each other to enable the first backpack member and the second backpack member to be unfolded in opposite directions, and configured to be exposed outward from the first backpack member and the second backpack member, a buckle for coupling at least both side portions of the first backpack member and the second backpack member to each other, wherein the auxiliary loading portion is formed by coupling a pair of panels to each other by a first hinge so as to be folded inward only, in which a first of the pair of panels coupled by the first hinge is rotatably fixed to the first backpack member via a second hinge attached to exterior of the first backpack member, and a second of the pair of panels coupled by the first hinge is rotatably fixed to the second backpack member via a third hinge attached to the exterior of the second backpack member, so that a gap between the first backpack member and the second backpack member is prevented from being widened, and the first hinge and the pair of panels folded only inward prevent an article loaded on the auxiliary loading portion from sagging, thereby preventing a center of gravity of the backpack from being changed.

2. The backpack of claim 1, wherein the first backpack member serves as a backrest, and the second backpack member includes a storage portion.

3. The backpack of claim 1, wherein the first backpack member and the second backpack member include storage portions, respectively.

4. The backpack of claim 1, wherein each of the first backpack member and the second backpack member has a front panel and a back panel to form an enclosure, and wherein the back panels of the first backpack member and the second backpack member contact each other when the auxiliary loading portion is folded inwardly.

5. The backpack of claim 1, wherein each of the first backpack member and the second backpack member has a resealable closure.

6. The backpack of claim 5, wherein the resealable closure is a zipper.

* * * * *